US005680817A

United States Patent [19]

Fontana

[11] Patent Number: 5,680,817

[45] Date of Patent: Oct. 28, 1997

[54] APPARATUS FOR THE COMPLETE AUTOMATIC WASHING OF PRINTING UNITS OF PRINTING MACHINES WITH ROTATING ROLLERS

[75] Inventor: Felice Fontana, Como, Italy

[73] Assignee: Reggiani Macchine S.P.A., Bergamo, Italy

[21] Appl. No.: 562,683

[22] Filed: Nov. 27, 1995

[30] Foreign Application Priority Data

Nov. 30, 1994 [IT] Italy ..... MI94A2421

[51] Int. Cl.[6] ..... B41F 35/00

[52] U.S. Cl. ..... 101/424; 101/423

[58] Field of Search ..... 101/424, 423, 101/425; 15/256.51, 1.51

[56] References Cited

U.S. PATENT DOCUMENTS

| | | | |
|---|---|---|---|
| 3,737,940 | 6/1973 | Moestue et al. | 101/425 |
| 3,986,450 | 10/1976 | Zimmer | 101/425 |
| 5,099,758 | 3/1992 | Hassler et al. | 101/424 |

*Primary Examiner*—Edgar S. Burr
*Assistant Examiner*—Anthony H. Nguyen
*Attorney, Agent, or Firm*—McAulay Fisher Nissen Goldberg & Kiel, LLP

[57] ABSTRACT

An apparatus for automatically washing printing units of printing machines with finely perforated rollers, which includes: a hollow body that constitutes the washing water chamber and is anchored laterally and parallel to the color feed tube and has, at its base, a series of nozzles, which are directed towards the inside of the wedge-shaped suction chamber, and a series of similar nozzles which are directed towards the rear part of the suction chamber. A series of nozzles is associated with the color feed tube to direct the color towards the secondary rotating roller and to feed the washing water into the finely perforated roller when printing ends. The apparatus is also provided with wear-preventing pads between the rotating secondary roller and the suction chamber, with pads for axially retaining the secondary roller, and with a device for washing under pressure the opposite ends of the color feed tube, the tubular ends of the washing chamber, and the rings of the finely perforated roller.

6 Claims, 2 Drawing Sheets

APPARATUS FOR THE COMPLETE AUTOMATIC WASHING OF PRINTING UNITS OF PRINTING MACHINES WITH ROTATING ROLLERS

BACKGROUND OF THE INVENTION

1. Field of the Invention

The present invention relates to an improved apparatus for automatically washing all the various devices that form printing units used in printing machines with rotating rollers without moving them and in working position.

2. Description of the Prior Art

It is known that single- or multiple-color fabric printing machines with rotating rollers use printing units that have the following main components: a finely perforated roller (screen), which can rotate over the fabric guided on an endless belt conveyor, and inside which the color is introduced by virtue of a tubular manifold and distributor; and a secondary roller made of magnetizable metal that is also located inside the roller and is pressed onto the fabric by magnetic attraction, so as to squeeze the color through the fine perforations of the roller, thus printing the fabric.

It is also known that after each printing operation it is necessary to wash the components of the printing unit and of the belt; the endless belt is normally washed and cleaned by a washing unit with which the machine itself is equipped, whereas the components of the various printing units are removed from the worktable and washed inside appropriate washing units.

All these operations require the use of labor and entail rather significant amounts of time, in addition to consuming large amounts of water to wash the various components of the printing unit.

In order to obviate the onerous operations for washing the printing units separately from the machine, some fully automatic washing devices have already been proposed that keep the units motionless in working position, as, for example, in EP-A-0277481.

A further improvement was disclosed in EP-A-0494339. The apparatus disclosed in EP-A-0494339 has two straight coaxial tubes which are arranged inside the printing roller so that the innermost tube acts as tube for distributing the color through a series of conventional nozzles and so that the annular interspace formed by the tubes, which is also provided with nozzles, acts as distributor for the washing water inside the roller. The distribution tube, the interspace, and the color feed pump can be alternately connected, according to cycles that have a preset duration and by means of electric valves that act according to a program, to a pump for feeding pressurized washing water and to a compressed air pump. A narrow hollow body is associated with the coaxial tubes and constitutes a suction chamber. The body is connected to a suction pump, and is arranged in front of the secondary roller. The body is also provided with a series of aligned magnetized plates which have alternating polarities and are suitable to raise the secondary roller every time the magnetic attraction applied by the electromagnet located below the printing belt is interrupted.

Multiple openings are also formed at least on the bottom of the hollow suction body and are suitable to produce a continuous suction and therefore transfer towards the discharge the mixture formed by the washing water and by the color that has remained in the roller. The complete washing cycle is adjusted automatically by a microprocessor which is programmed beforehand so that at the end of each printing operation pressurized washing water is fed into the color pump and the mixture is discharged directly through the color feed tube and inside the roller intermittently, alternating this action with the feeding of compressed air so as to produce alternating water-air cycles combined with cycles in which the secondary print roller is lifted and lowered by means of the magnetized plates. The apparatus is also provided with a particular means for washing the ends of the color feed tube and the opposite rings of the finely perforated roller.

Although very effective and quick to use, the apparatus of EP-A-0494339 can be improved. For example in the case of very long units, it may be too heavy, structurally complicated, and difficult to handle in the case of printing units that use very large finely perforated rollers. It may also be difficult to wash the inside of the hollow body that constitutes the suction chamber. Furthermore, in some operating conditions the color does not distribute uniformly inside the printing roller, and the metal secondary rollers wear excessively when they make contact with the end portion of the body that constitutes the suction chamber.

SUMMARY OF THE INVENTION

Accordingly, the aim of the present invention is to provide an apparatus for automatically washing the various components of the printing units of printing machines with rotating rollers that is conceived so as to obviate the drawbacks and limitations of current washing devices.

A further object is to provide a structurally simpler apparatus which is also easy to handle even in case of very long units, and significantly lighter than known devices, with obvious advantages also as regards its insertion and removal from the printing roller.

Still a further object of the invention is to provide an apparatus of the above specified type that significantly reduces color waste during washing every time the color is changed.

Still a further object is to provide an apparatus that is easy to handle during storage after each printing operation.

This aim, these objects, and others which will become apparent hereinafter are achieved by an apparatus for the complete automatic washing of all the components of a printing unit of printing machines with rotating finely perforated rollers which are kept motionless and in working position, of the type that includes: a doctor with a magnetic roller; a fixed color feed tube which is located inside the printing roller and is connected to a color pump; a suction chamber that is connected to a suction pump and is rigidly coupled to the color feed tube; a tubular means that is connected to a pressurized water pump and is suitable to feed pressurized washing water into the roller; a series of distribution nozzles which are associated with the color feed tube; and a series of nozzles that protrude from the tubular means to feed the washing water into the roller, into the suction chamber, and into the color feed tube; the tubular means and the color pump being connectable, according to cycles of preset duration and by means of programmed-action electric valves, to each other, to the pressurized washing water feed pump, and to a suction pump for initially removing the color from the color feed tube and from the finely perforated roller before washing begins; characterized in that it includes, in combination:

a hollow structure that is anchored laterally to the color feed tube, runs lengthwise so as to substantially match the extension of the finely perforated part of the printing roller, and is suitable to constitute a chamber for the washing water supplied by the pump by means of a portion of tube that protrudes from the chamber and runs parallel to the end portion of the color feed tube; the chamber being provided, at the opposite end, with a similar tube portion that is parallel to the color feed tube and is meant to discharge the water mixed with color;

a suction chamber, substantially a hollow body shaped like a narrow wedge-shaped box or the like, which is rigidly coupled to the base of the washing chamber and is connected to it by means of a first series of equidistant nozzles, which allow to wash the internal walls of the suction chamber and to subsequently aspirate the water mixed with color during the washing of the various components of the printing unit;

a second series of equidistant nozzles which are formed at the base of the washing water chamber and are directed outward and towards the suction chamber so as to allow to wash the rear vertical wall of the suction chamber;

an additional series of equidistant nozzles which are anchored to the color feed tube and are orientated so as to direct the color towards the secondary printing roller during printing and so as to direct washing water onto the front wall of the suction chamber at the end of the printing process;

a series of members made of antifriction material, which are anchored, with a preset constant spacing, to the lower part of the front side of the suction chamber and are suitable to prevent wear of the secondary printing roller and of the wall of the chamber during the operation of the machine;

two further members made of antifriction material, which are mounted vertically and so that they can move freely with respect to each other at the lower end of the front wall of the suction chamber, face the opposite ends of the secondary printing roller, and are suitable to prevent axial movements of the secondary roller during printing operations;

a device for automatically washing the ends of the pairs of parallel tube portions that protrude at the opposite ends of the color feed tube and of the washing water chamber; and a means for washing the ends of the finely perforated roller, which is constituted by a single curved plate which is anchored transversely to the two opposite pairs of parallel tube portions and is provided with internal grooves that are connected to the washing water chamber and are suitable to direct pressurized washing water jets onto the ends of the parallel tubes, nozzles being furthermore provided which are directed towards the rings of the roller to allow to remove the color accumulated in them during printing.

More particularly, the washing chamber, which is rigidly anchored laterally to the conventional color feed tube, is constituted by a box-like body which has a substantially quadrangular cross-section and has, at its opposite ends, a tube portion which lies parallel to the end portion of the color feed tube and is rigidly connected to it, so as to constitute two pairs of parallel tubes that can be connected to the opposite heads of the printing unit.

The series of nozzles for washing the wedge-shaped suction chamber both on the inside and on the outside is formed so as to deliver a planar jet of water that is suitable to form a continuous film of water on all the surfaces of the suction chamber.

BRIEF DESCRIPTION OF THE DRAWINGS

Further characteristics and advantages of the present invention will become apparent from the following detailed description, given with reference to the accompanying drawings provided only by way of non-limitative example, wherein.

DESCRIPTION OF THE PREFERRED EMBODIMENTS OF THE INVENTION

Figure 1:
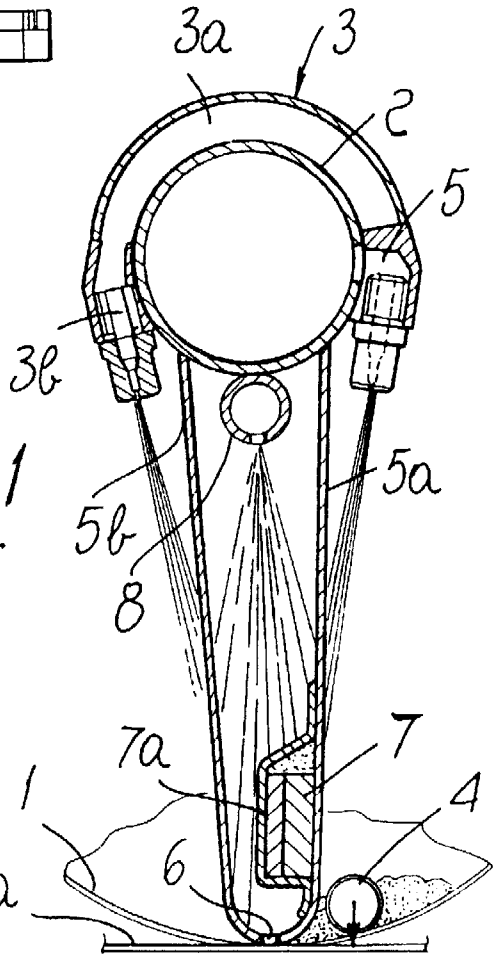
FIG. 1 PRIOR ART
FIG. 1 is a transverse sectional view of a prior art apparatus for automatically washing printing units.

All the improvements according to the present invention can be used in a conventional printing unit which is provided with an in-line washing system such as the one shown in FIG. 1 merely by way of example, in a transverse cross-section.

Accordingly, with reference only to FIG. 1, the prior art printing unit is substantially constituted by a finely perforated roller 1 which is supported by two opposite motorized end heads (not shown) and can rotate in contact with an endless belt la to which the fabric to be printed is glued. The color feed tube 2 is mounted coaxially inside roller 1 and is connected, at one of its ends, to a color feed pump. A magnetizable secondary roller 4 is placed in contact with the lower generatrix of roller 1 and is constantly attracted towards a belt 1*a* by an electromagnet located below a belt 2*a*, which forces to color delivered by nozzles 5 of color feed tube 2 to pass through the fine perforations of the roller, thus printing the fabric.

A further tube 3 is arranged externally and coaxially with respect to color feed tube 2, and therefore an interspace 3*a*, that forms between the coaxial tubes, produces a duct for washing roller 1 with water that is fed under pressure and flows out towards the internal surface of the roller by means of the series of nozzles 3*b*.

Color feed tube 2 is connected to a conventional color feed pump at one end and has, at its opposite end, an electric valve whose outlet leads to a discharge.

A narrow box-like hollow body is associated with tube 3 and is formed by two facing walls 5*a*–5*b*. The lower closing side of the body is at a very small distance from the internal surface of roller 1 and has a series of equidistant holes or openings 6.

An aligned series of magnetized plates 7 is arranged inside the hollow body 5*a*–5*b*. The plates are enclosed within a box-like body 7*a* and are arranged with alternating polarities; their function is to attract and raise the secondary roller 4 away from the roller during washing cycles every time printing operations are interrupted.

The channel formed by walls 5*a*–5*a* acts as a suction channel for aspirating the mixture of washing water and color that is produced during the cycles for washing the roller and color feed tube 2. Suction is provided by a suction pump (not shown) which is connected to interspace 3*a* and sends the aspirated water-color mixture directly to the discharge. A small tube 8 is provided inside suction channel 5*a*–5*a* and is suitable to feed pressurized washing water onto the walls of the channel.

The apparatus is provided with a pump (not shown) for feeding washing water and with a compressed air source. The pump and the source are suitable to feed pressurized washing water through a connector into the color feed pump, into the ducts connected to the color feed tube, into color feed tube 2, and into interspace 3*a*. Finally, an appropriately programmed microprocessor is associated with the apparatus and is suitable to control the alternating and preset-duration interventions of the pumps, of the electric valves, and of the lifting and lowering actions of printing roller 4.

The present invention applies a series of structurally and functionally substantial modifications to an apparatus such as the one described with reference to FIG. 1. All of these modifications reduce the constructive complexity and weight of the apparatus, improve its handling, and significantly reduce color wastes during the various washing steps for color changes and/or roller pattern changes. With reference to FIGS. 2 to 8, the apparatus for the automatic in-line washing of one or more printing units with rotating rollers has, according to the invention (FIGS. 2 and 4), first of all a chamber for the water for washing all the components of the printing unit. The chamber is constituted by a narrow and hollow box-like body 9 which has a substantially quadrangular or polygonal transverse cross-section and is anchored laterally and externally with respect to color feed tube 2, so as to have a substantially horizontal base 9*a*.

Figure 2:
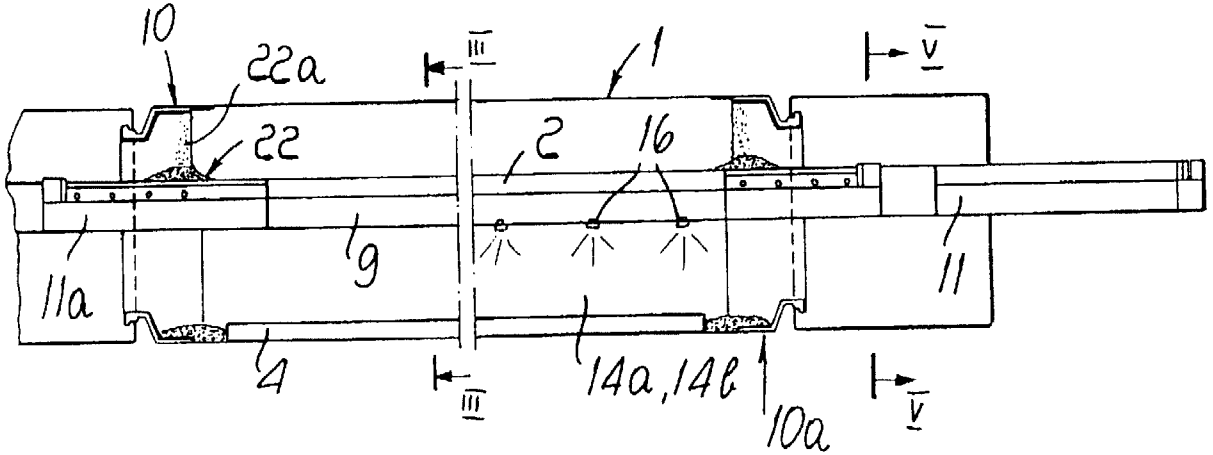
FIG. 2 is a schematic top view of a washing apparatus, according to the invention, inserted within a conventional finely perforated roller.
Figure 3:
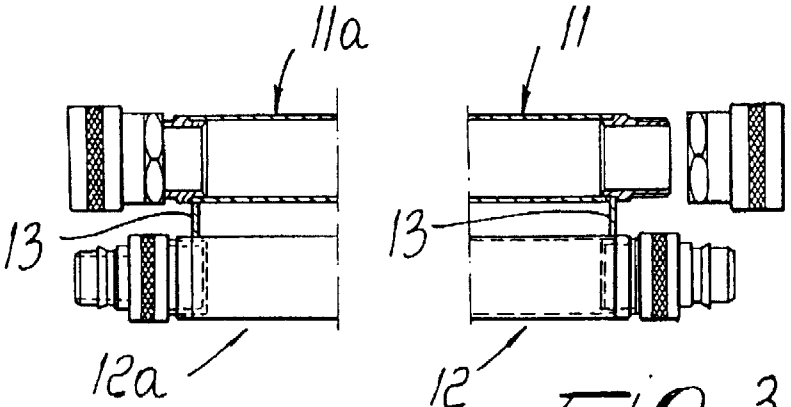
FIG. 3 is an enlarged-scale view that shows only the pairs of tube portions that protrude from the opposite ends of the color feed tube and of the washing water chamber.

Chamber 9 runs lengthwise to as to substantially match the finely perforated region of roller 1 that normally lies between the opposite rings 10–10*a* of the roller (FIG. 2).

Two tube portions 11–11*a* (FIG. 3) protrude from the opposite ends of the washing water chamber 9 and run parallel to color feed tube 2. Likewise, two tube portions 12–12*a* parallel to the first portions protrude from the opposite ends of color feed tube 2. The pairs of parallel tubes are mutually rigidly anchored by braces 13 or the like.

Tube portion 11 is provided to feed the washing water to chamber 9, whereas a parallel tube 12 is provided to feed the printing color. On the other side of chamber 9, tube 12*a* is used to discharge the printing color before washing begins, whereas tube portion 11*a* is used to aspirate and discharge the color-water mixture that forms in the roller during the various steps of the washing of the entire printing unit.

Suction chamber 14 is welded to base 9*a* of washing water chamber 9 and is shaped like an elongated hollow body. The chamber encloses a series of permanent magnets 7*a* between its walls 14*a*–14*b* and has, on its bottom, a series of openings 6*a* for aspirating the water and color mixture during washing.

A series of special flat-jet nozzles 15 is inserted in base portion 9*a* of chamber 9 that lies between walls 14–14*a*. These nozzles are suitable to distribute the washing water in the form of a continuous film of water that is distributed over the entire length of internal walls 14–14*a* of suction chamber 14, thus fully cleaning the inside of chamber 14 and permanent magnets 7*a*.

A similar series of flat-jet nozzles 16 is also associated with base 9*a* of washing water chamber 9 but outside suction chamber 14. These nozzles are orientated so as to continuously wash the outer surface of wall 14*a*, and another series of nozzles 17 is provided at the base of color feed tube 2 and has the dual function of directing the color towards the magnetic secondary roller 4 during printing operations and of distributing washing water onto front wall 14*b* of the suction chamber during the washing of the color feed tube when printing ends (FIG. 4).

Also according to the invention, in order to prevent the friction-induced wear, that occurs during printing because of the contact between the lower part of the metal wall 14*b* of the suction chamber and the rotating secondary roller 4, there are members or pads 18 (FIGS. 4–5) made of antifriction material which are capable of preventing direct contact, and therefore wear, between the metal part and the rotating secondary roller. As clearly shown by FIG. 5, pads 18 are constituted by very thin disks or quadrangular plates, which are centrally provided with a stem 18*a* that is knurled or toothed along its peripheral region. The stem of the disks is inserted by pressing within mutually equidistant holes formed in wall 14*b*, as shown in FIG. 4.

Figure 4:
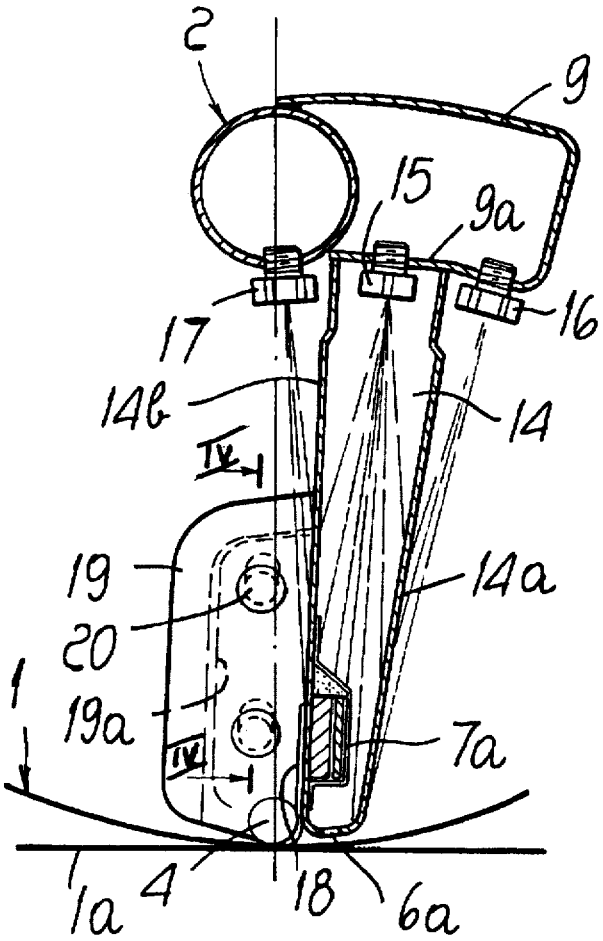
FIG. 4 is an enlarged-scale transverse sectional view of the apparatus of FIG. 2, taken along the plane III—III.
Figure 5:
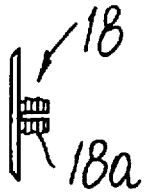
FIG. 5 is a view of a detail of the apparatus according to the invention.
Figure 6:
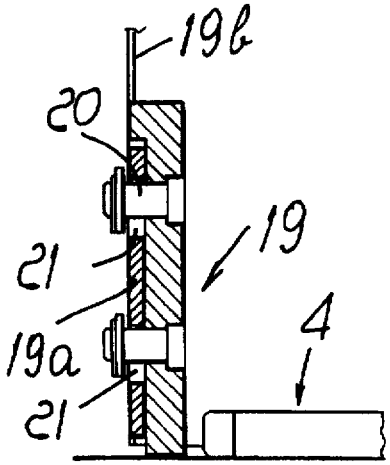
FIG. 6 is a sectional view, taken along the plane IV—IV of FIG. 4.
Figure 7:
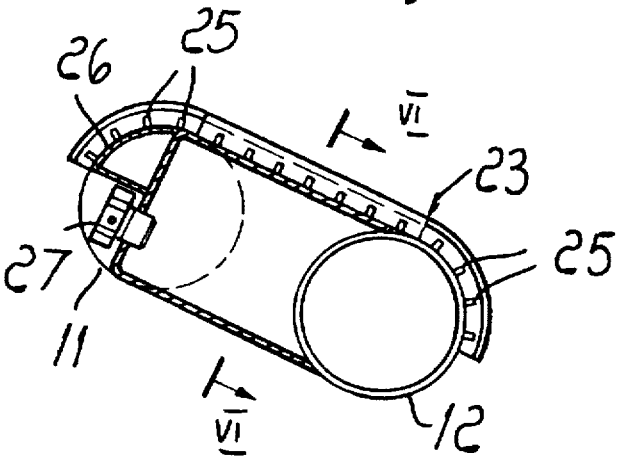
FIG. 7 is a sectional view, taken along the plane V—V of FIG. 2.
Figure 8:
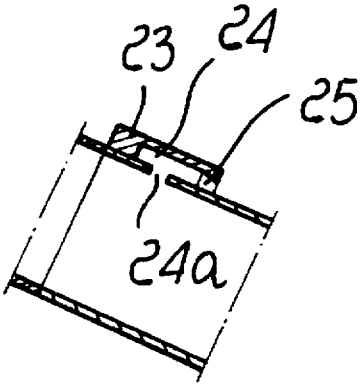
FIG. 8 is a sectional view, taken along the plane VI—VI of FIG. 7.

Furthermore, in order to prevent axial movements of secondary printing roller 4 during the operation of the machine, there are two retaining pads, generally designated by the reference numeral 19 in FIGS. 4 and 6, which are arranged so as to face the opposite ends of the secondary roller.

Each pad 19 is constituted by a plate 19*a* which is arranged vertically and is stably anchored to front wall 14*b* of the suction chamber 14 with its upper end 19*b* (FIG. 6). A second plate 21 made of antifriction material is associated so as to face fixed plate 19*a* and so that it can slide freely. The second plate is meant to rest, due to its own weight, on the surface of the printing roller, thus preventing secondary roller 4 from moving axially, regardless of the diameter of the secondary roller being used.

Finally, the present invention relates to a particular and effective device that is capable of automatically and continuously washing the opposite ends of the above described washing apparatus.

It is known that during printing the color contained in the roller 1 can accumulate at the ends, beyond the region where the secondary roller acts, in considerable amounts; these amounts cause color to drip onto the upper surface of the printing apparatus when the color, due to the rotation of the roller, is in the upper region, as referenced by the numerals 22 and 22*a* in FIG. 2.

Accordingly, during the washing operations it is necessary to remove this color that has deposited during printing and can be even very abundant and therefore difficult to remove.

The device according to the invention, in addition to being far less bulky, achieves this washing capability by means of a particular shape of the grooves from which pressurized water and air exit. The device is essentially constituted by a flat steel plate 23 whose ends are curved with a radius that is equal to the radius of tubes 11–12 (FIGS. 7–8) provided at the opposite ends of washing chamber 9 and of color feed tube 2. The shape of plate 23 matches the profile of the two parallel tubes and is stably anchored to them. A continuous cavity 24 (FIG. 8) is formed inside plate 23 and is connected to tube 11 by means of a continuous opening 24*a*. Multiple parallel grooves 25 are formed in the front wall of the chamber 24 and substantially form a washing comb which distributes washing water in an axial direction, that is to say, parallel to tubes 11 and 12. The washing water exits under pressure from the continuous chamber 24 and enters grooves 25, which are shaped so as to direct the water jets along the entire length of the ends of the apparatus, fully removing color 22 that has accumulated on them during printing operations.

A protective wall 26 is associated with washing comb 25 and is meant to protect water-film nozzles 27 (FIG. 7) from color dripping. These nozzles are provided to simultaneously wash end rings 10–10*a* (FIG. 2) of the finely perforated roller 1.

The automatic washing apparatus described above with reference to the accompanying drawings allows in practice to completely wash all the components of a printing unit, and particularly even very long units, with the advantage that in comparison with known apparatuses it is light and compact and also allows a significant saving in color, due to the fact that the color feed tube can be given a smaller diameter, than the tubes currently being used, accordingly reducing the amount of color to be removed by washing.

In its practical embodiment, the apparatus as described and illustrated is of course susceptible of structurally and functionally equivalent modifications and variations without abandoning the scope of the invention.

I claim:

1. Apparatus for automatically washing all the components of a printing unit of printing machines, in working position, comprising a printing roller having a finely perforated part and rings; a doctor with a magnetic roller; a fixed color feed tube arranged inside said printing roller; a suction chamber rigidly coupled to said color feed tube; a tubular means adapted to feed pressurized washing water into said printing roller; a series of distribution nozzles associated with said color feed tube; a series of nozzles that protrude from said tubular means to feed washing water into said printing roller, into said suction chamber, and into said color feed tube; said tubular means being fed with water, according to predetermined cycles, for initially removing the color from said color feed tube and from said printing roller before washing begins;

a hollow structure anchored laterally to said color feed tube and running lengthwise so as to substantially match the extension of said finely perforated part of said printing roller, said hollow structure constituting a washing chamber for the washing water supplied by means of a portion of tube that protrudes from said chamber and running parallel to an end portion of said color feed tube; said chamber being provided, at the opposite end, with a similar tube portion that is parallel to said color feed tube and is adapted to discharge the water mixed with color;

a suction chamber constituted by a narrow wedge-shaped hollow body, having internal walls, a rear vertical wall and a front wall, and being rigidly coupled to a base of said washing chamber and connected to said washing chamber by means of a first series of nozzles, for washing said internal walls and for subsequently sucking the water mixed with color during washing of the components of the printing unit;

a second series of nozzles formed at the base of said washing water chamber and directed outwards and towards said suction chamber for washing said rear vertical wall of said suction chamber;

an additional series of nozzles anchored to said color feed tube and oriented so as to direct the color towards a secondary printing roller during printing so as to direct washing water onto said front wall of said suction chamber at the end of the printing process;

a series of antifriction members anchored to a lower part of the from side of said suction chamber and adapted to prevent wear by contact of said secondary printing roller and of said wall of the chamber during the operation of the machine;

two further antifriction members mounted vertically and adapted to move freely with respect to each other at the lower end of said front wall of said suction chamber, said further antifriction members facing the opposite ends of the secondary printing roller and being adapted to prevent axial movements of said secondary roller during printing operations; and a device for automatically washing the ends of said pairs of parallel tube portions that protrude at the opposite ends of the color feed tube and of the washing water chamber; and a means for washing the ends of said printing roller, which is constituted by a single curved plate which is anchored transversely to the two opposite pairs of parallel tube portions and is provided with internal grooves that are connected to said washing water chamber and are suitable to direct pressurized washing water jets onto the ends of said parallel tubes, nozzles being provided which are directed towards said rings of said printing roller to allow to remove the color accumulated in them during printing.

2. Apparatus according to claim 1, wherein said washing is constituted by a boxlike body which has a substantially quadrangular transverse cross-section and has a tube portion at its opposite ends, said tube portion lying parallel to a further tube portion that protrudes axially from the ends of the color feed tube and is rigidly connected thereto, so as to form two opposite pairs of parallel tubes that can be connected to the opposite heads of the printing unit.

3. Apparatus according to claim 1, wherein said series of nozzles, connected to said washing water chamber, are adapted to deliver a flat jet of water that is suitable to form a film of pressurized water directed onto all of the surfaces of the suction chamber.

4. Apparatus according to claim 1, wherein said antifriction members are disk-shaped and regularly spaced on a lower front side of said suction chamber.

5. Apparatus according to claim 1, wherein a device is provided at the opposite ends of the secondary printing roller for axially retaining said secondary roller, said device comprising two vertically arranged plates made of antifriction material; a first one of said plates being rigidly anchored to said front part of the suction chamber, and a second one of said plates sliding freely and being guided against said first plate so as to constantly rest on said printing roller so as to face said secondary roller.

6. Apparatus according to claim 1, comprising nozzles associated with said washing chamber and directed towards said rings of said printing roller.

* * * * *